United States Patent [19]

Grefe

[11] Patent Number: 4,552,050

[45] Date of Patent: Nov. 12, 1985

[54] DIE, PLATEN AND JOINING MEANS FOR ATTACHING SAID DIE TO SAID PLATEN

[75] Inventor: Peter Grefe, Laguna Beach, Calif.

[73] Assignee: Shur-Lok Corporation, Irvine, Calif.

[21] Appl. No.: 578,762

[22] Filed: Feb. 9, 1984

Related U.S. Application Data

[63] Continuation-in-part of Ser. No. 363,274, Mar. 29, 1982.

[51] Int. Cl.[4] ..... B26F 1/14

[52] U.S. Cl. ..... 83/685; 83/698; 100/918

[58] Field of Search ..... 83/698, 685, 563; 72/448, 446; 100/918

[56] References Cited

U.S. PATENT DOCUMENTS

| | | | |
|---|---|---|---|
| 3,009,747 | 11/1961 | Pitzer . | |
| 3,178,984 | 4/1965 | Barthoy | 83/637 |
| 3,192,820 | 7/1965 | Pitzer | 411/33 |
| 3,332,308 | 7/1967 | Keen | 83/698 X |
| 3,709,088 | 1/1973 | Pitzer . | |
| 4,017,267 | 4/1977 | Hawley | 83/698 X |

*Primary Examiner*—James M. Meister

*Attorney, Agent, or Firm*—K. H. Boswell; Edward D. O'Brian

[57] ABSTRACT

A set of platens locatable as for instance on a die shoe and a slide die each contain a recess sized and shaped so as to partially receive one die of a set of dies. The platens further contain a wall which extends between the outer periphery of the platen and the recess with a hole extending through the wall and opening into the recess. The dies have a corresponding hole positioned in the dies so as to align with the holes in the walls when the dies are appropriately located in the recesses in the respective platens. A fastener has a shank with a handle having cam surfaces thereon located on one end of the shank and a flared head on the other end of the shank. A sleeve having a tapered tip fits on the shank between the cam and the tapered head with an expandable bushing then positioned between the sleeve and the head. Movement of the sleeve toward the head expands the bushing so as to lock the fastener in the aligned holes between the walls and the dies. Preferredly, the bushing would lock in the holes at the interface of the die and the wall.

14 Claims, 5 Drawing Figures

DIE, PLATEN AND JOINING MEANS FOR ATTACHING SAID DIE TO SAID PLATEN

CROSS REFERENCE TO RELATED APPLICATIONS

This application is a continuation in part of my application Ser. No. 363,274, filed Mar. 29, 1982and entitled, "Combination Die and Die Support Structure", the entire contents of which are herein incorporated by reference.

BACKGROUND OF THE INVENTION

This invention is directed to new and improved structures for conveniently and fixedly fastening dies to platens and the like in such a manner allowing for easy interchange of the individual dies on the platens.

In my application entitled, "Combination Die and Die Support Structures", application Ser. No. 363,274, the entire contents of which are herein incorporated by reference, I discuss the nature of certain particular dies, platens and the like which are utilized in stamping, embossing, forming and the like of metal, plastic or other materials. In that application, the importance of correct alignment of the dies is also noted. The application discloses a method of attaching dies to platens, die shoes or the like utilizing certain expandable fasteners.

In many industrial processes, it is necessary to utilize a particular stamping or press machine in combination with a variety of different sets of dies. It is important for the economics of operation of these presses or stamping machines that the dies be easily and conveniently attached to the machines without an undue amount of labor or time spent in aligning one of a set of dies with respect to the other die of a set of dies in order for them to function properly. Misalignment of the matching dies can be catastrophic with respect to the dies themselves, and as such, it is extremely important to insure correct alignment of the dies with respect to each other.

In operations wherein the dies in any particular machine will be changed at fairly short intervals, the time it takes to attach and align a set of dies to the machine becomes a critical factor in the economics of the operation of the machine. In view of this, it is considered that there exists a need for improved methods of attaching dies to these machines in such a manner as to insure the alignment of the dies of any individual set with respect to one another while also allowing for fast and secure attachment of the dies to the machines in aligned positions.

BRIEF DESCRIPTION OF THE INVENTION

In view of the above, it is a broad object of this invention to provide improved dies, support structures and fastening means which allow for easy and convenient attachment of the dies to the support structures while at the same time maintaining correct alignment of the individual dies of a set of dies once attached to the support structure. It is an additional object of this invention to provide a fastening means which is simplified with respect to prior fastening means yet insures correct alignment of the dies in attaching the same to platens or the like, or for other uses wherein the fastening means would be utilized to join two parts by positioning the fastening means in aligned holes between the parts.

These and other objects, as will become evident from the remainder of this specification, are achieved in a combination of a die set and set of supports for holding the dies of said die set, means for connecting each die of said die set to one of said supports and means for causing relative movement between said supports so as to result in relative movement between said dies of said die set the improvement which comprises: said supports including a first platen and a second platen, each of said platens including a die receiving recess located therein, one of said dies of said set of dies at least partially locatable within said recess of said first platen and the other of said dies of said set of dies at least partially locatable within said recess in the second of said platens; each of said platens further including a wall, said wall located between the outer periphery of said respective platen and said recess of said respective platen; said connecting means including said walls on each of said respective platens having a hole extending through said wall and opening into said recess on each of said respective platens and further including each of said dies of said set of dies having a hole which aligns with the hole in said wall of the respective platen when said die of said set of dies which is at least partially locatable in said recess in said respective platen is located in said respective recess; said connecting means further including at least two expandable diameter fastener means each having a generally cylindrical shape capable of being manipulated so as to expand to a greater diameter at a point along its length, one of said fastener means extending into said aligned holes in each of said dies and said wall of said respective platens with said fastener means expanded at said point to said greater diameter to tightly fit at said point within said aligned holes to fixedly attach each of said dies to their respective platens.

Further, these objects are achieved in a fastener having an elongated cylindrical shank having ends and including a truncated conical shank head at one of said ends with said shank head attaching to said shank at the small end of the truncated conical shank head and flaring outwardly in a continuous taper from the diameter of said shank to a greater diameter; cam means pivotally attaching to the other of said ends of said shank; an elongated sleeve means having ends, said sleeve means slidably located on said shank between said cam means and said head with one end of said sleeve means in operative association with said cam means so as to be movable on said shank in response to pivoting of said cam means on said shank, said sleeve means having an essentially constant diameter from one of its ends along its length toward the other of its ends and terminating in a tapered tip at said other of its ends, said tapered tip tapering inwardly from said constant diameter in a smooth taper to a smaller diameter at the extremity of the other of said ends; an expandable bushing means having open ends and slidably located on said shank between said tapered tip of said sleeve means and said shank head, the inside diameter of said bushing means tapering from an essentially mid point toward each of its ends from a first thickness at said midpoint to a second thinner thickness at each of its ends such that when said sleeve is slid on said shank under the influence of said cam means towards said head said bushing is engaged between said head and said tapered tip of said sleeve and is expanded as said tapered tip of said sleeve moves toward said head.

BRIEF DESCRIPTION OF THE DRAWINGS

This invention will be better understood when taken in conjunction with the drawings, wherein.

This invention utilizes certain principles and/or concepts as are set forth in the claims appended to this specification. Those skilled in the mechanical arts will realize that these principles and/ or concepts are capable of being utilized in a variety of embodiments differing from the exact embodiment utilized for illustrative purposes herein. For this reason, this invention is not to be construed as being limited only to the illustrative embodiments, but is to be construed as being limited only in light of the claims.

DETAILED DESCRIPTION OF THE INVENTION

For the purposes of this specification, the word "die" is construed to indicate a tool or the like utilized in conjunction with a further tool to form a set of dies. The set of dies are utilized to bend, fold, reduce, curl, punch, pierce, cut, shear and the like by inserting a working material between the two dies and bringing one die toward the other.

Figure 1:
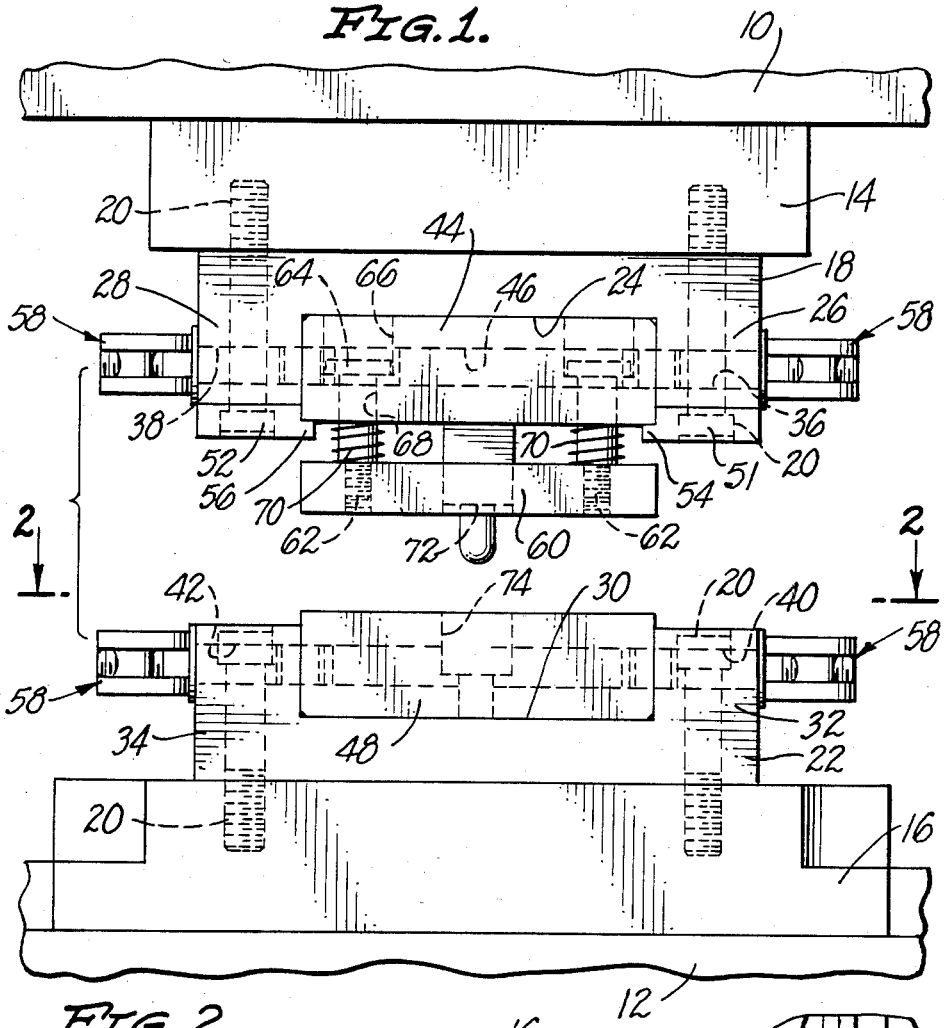
FIG. 1 is a front elevational view showing a typical press incorporating the dies, platens and fasteners of the invention.

Referring to FIG. 1, an upper press plate 10 and a lower press plate 12 of a typical press are illustrated with an upper die shoe 14 attaching to the upper press plate 10 and a lower die shoe 16 attaching to the lower press plate 12. These are standard in the art and could take the form of any number of typical die shoes which are commonly used in the production industries and the like. Typical guide rods and bushings could be attached to the die shoes 14 and 16 so as to align the same, also in a standard manner.

Attaching to the upper die shoe 14 is an upper platen 18. The platen 18 is attached to the die shoe 14 utilizing four socket head cap screws collectively identified by the numeral 20, which are threaded into appropriate holes tapped into the die shoe 14. Likewise, a lower platen 22 is attached to the lower die shoe 16 by similar cap screws also identified by the numeral 20, which thread into appropriate holes tapped into the lower die shoe 16.

If the upper and lower die shoes 14 and 16 are appropriately guided with respect to one another via the use of standard guide rods and bosses, the alignment of the upper die shoe 14 will always be the same with respect to the lower die shoe 16. Likewise, the upper platen 18 will always be aligned with the lower platen 22. In this way, once the platens 18 and 22 are aligned with one another, any one of a number of sets of dies can be conveniently mounted onto the platens 18 and 22 with alignment of the individual dies of the set of dies insured because of the alignment of the platens 18 and 22.

The upper platen 18 includes a recess 24 which is formed therein so as to form a right wall 26 and a left wall 28 which divide the right and left peripheries of the upper platen 18 from the recess 24.

In a like manner, the lower platen is machined to include a lower recess 30 with a similar right wall 32 and left wall 34 being formed in the lower platen and positioned between the right and left extremities and the recess 30. As such, the upper right and left walls 26 and 28 are parallel with one another and in a like manner so are the lower right and left walls 32 and 34.

A hole 36 extends through the upper right wall 26 and opens into the recess 24. Likewise, a hole 38 extends through the left wall 28 and also opens into the recess 24. The holes 36 and 38 in fact are aligned with one another and can be formed in a continuous machining operation during the machining of the upper platen 18.

In a similar manner, a hole 40 is formed in the right wall 32 of the lower platen 22 and a hole 42 formed in the left wall 34 of the lower platen 22. The holes for the bolts 20 are positioned near the four respective corners of the upper and lower platens 18 and 22 such that the holes 36, 38 40 and 42 can be appropriately positioned about midway in the respective walls 26, 28, 32 and 34. It will be appreciated that other configurations of the holes for the cap screws 20 and the holes 38, 38, 40 and 42 could be conveniently utilized.

An upper die 44 is located within the recess 24 in the upper platen 18. The upper die 24 includes a hole 46 drilled therein which aligns with both the hole 36 in the right wall 26 and the hole 38 in the left wall 28 when the upper die 44 is positioned in the upper platen 18. In a similar manner, a lower die 48 is positioned within the recess 30 in the lower platen 22. The lower die 48 also includes a hole 50 drilled therein which extends through the die 48 such that the hole 50 correctly aligns with the holes 40 and 42 in the right and left walls 32 and 34 respectively of the lower platen 22. It is of course realized that two separate holes could be utilized in place of the single hole 38 or 50. As for instance, a hole could project through right wall 26 and open into recess 30 with a second hole projecting through left wall 28 which also opened into recess 30. These two holes would not necessarily need to be aligned with one another.

Figure 2:
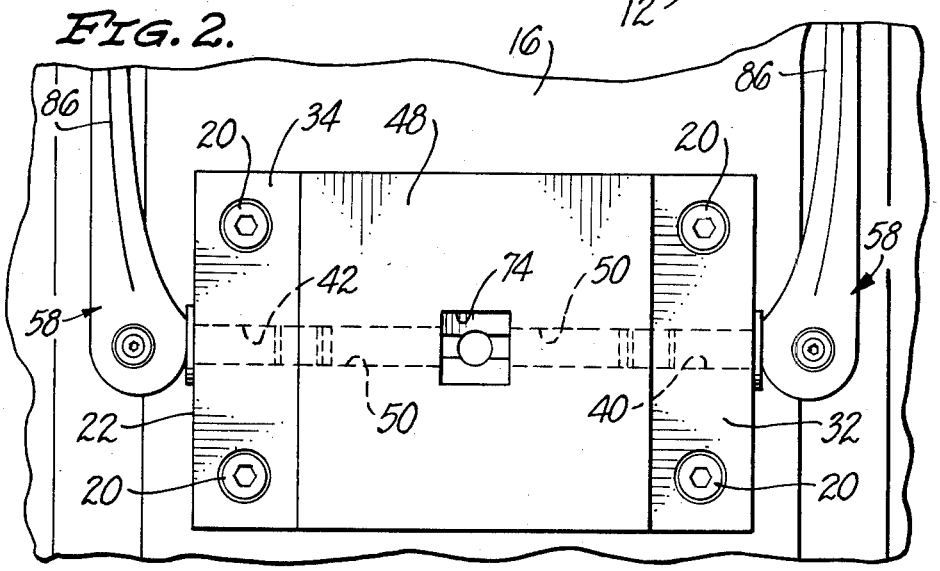
FIG. 2 is a plan view about the line 2—2 of FIG. 1.

The upper and lower dies 44 and 48 can be any one of a number of die configurations such as the male and female type dies illustrated in FIGS. 1 and 2. In any event, the upper and lower dies 44 and 48 will each include one or more holes which is appropriately drilled therein in a position so as to correctly align with the holes in the side walls of the respective recesses in the respective platens.

As is evident in FIG. 1 for the illustrative embodiment, the holes through the walls 26 and 28 of the upper platen and the aligned hole 46 in the upper die can extend in a plane which is essentially parallel with a similar plane in which the holes associated with the lower platen 22 and lower die 48 are located. Other configurations or orientations are, of course, also useful.

In order to facilitate location of the upper die 44 in the upper platen 18, right and left keepers 51 and 52 are appropriately bolted to the right and left walls 26 and 28 when the platen 18 is attached with the cap screws 20 to the die shoe 14. The keepers 51 and 52 include flanges 54 and 56 formed thereon, respectively, which extend over the recess 24 so as to form a type of drawer lock for sliding the upper die 44 into the upper platen 18 and preventing the same from falling under the influence gravity down towards the lower die 48 prior to appropriate alignment and fixing of the upper die 44 into the upper platen 18.

Figure 3:
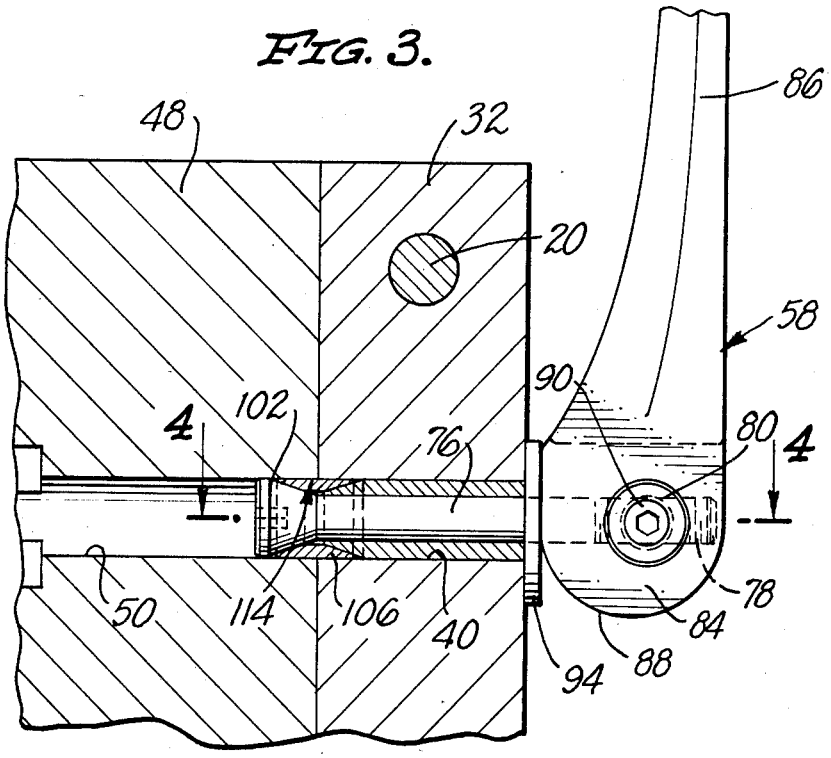
FIG. 3 is a fragmentary plan view in partial section of a portion of the invention shown in FIG. 2.
Figure 4:
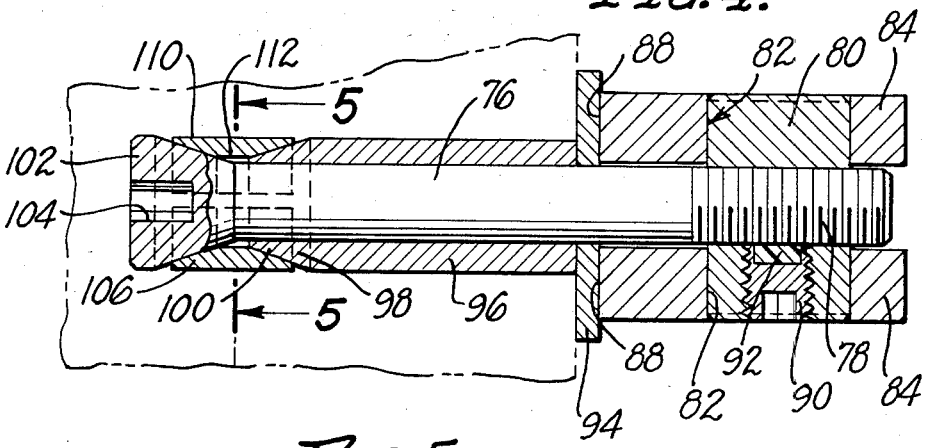
FIG. 4 is a side elevational view in partial section about the line 4—4 of FIG. 3.
Figure 5:
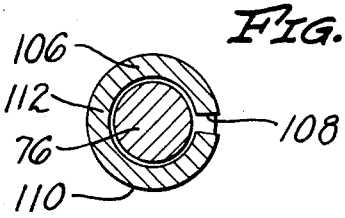
FIG. 5 is an end elevational view in section about the line 5—5 of FIG. 4.

Both the upper die 44 and the lower die 48 are fixed into the respective platens 18 and 22 utilizing fasteners collectively identified by the numeral 58, which are more fully illustrated in FIGS. 3, 4 and 5. In FIGS. 1 and 2 two each of the fasteners 58 are utilized to attach both the upper die 44 and the lower die 48 to their appropriate platens 18 and 22.

For the upper die 44 illustrated, a stripper plate 60 can also be attached thereto to facilitate part removal from the dies 44 and 48 after a typical punching and stamping operation. The stripper plate 60 is appropriately attached to the upper die 44 utilizing bolts collectively identified by the numeral 62, each of which have flared heads collectively identified by the numeral 64. The bolts 62 thread into the stripper plate 60 and pass through the appropriate drillings in the upper die 44. These drillings include a large diameter drilling 66 sized so as to freely allow movement of the bolt head 64 therein and a further drilling 68 sized so as to allow free movement of the bolt 62 therein as the stripper plate 60 moves up and down in working against the upper die 44. Springs, collectively identified by the numeral 70, are utilized to urge the stripper plate 60 away from the upper die 44 when the upper die 44 is lifted upwardly from the lower die 48. This will cause a stripping action of a part off of the male element 72 formed on the upper die 44. The male element 72 appropriately works in conjunction with a female element 74 formed in the lower die 48.

Each of the fasteners 58 have a shank 76 which is threaded on end 78 so as to receive a barrel nut 80. The barrel nut 80 extends into openings collectively identified by numeral 82 formed in bifurcated arms collectively identified by the numeral 84 of a cam handle 86. The barrel nut 80 is free to turn within the cam handle 86 and as the cam handle 86 is rotated on the barrel nut 82, of course the cam surfaces 88 of the cam handle 86 are moved. The position of the barrel nut 80 with respect to the threads on the end 78 of the shank 76 is fixed utilizing a set screw 90 which engages and compresses a plastic plug 92 between itself and the threads on the shank 76. This fixedly holds the barrel nut 80 to the shank 76 without stripping the threads on the end 78 of the shank 76.

Positioned adjacent to the cam surfaces 88 on the cam handle 76 is a washer 94. Adjacent to the washer 94 and slidably mounted on to the shank 76 is a sleeve 96. The sleeve 96 has a constant diameter over the majority of its elongated surface except near its end 98 wherein it tapers. The taper on the end 98 forms a tapered tip 100 on the sleeve 96 with the tapered tip tapering inwardly from the diameter along the majority of the sleeve 96 to a smaller diameter at the extremity of the end 98 of the sleeve 96.

The end of the shank 76 opposite the end 78 includes a shank head 102. The shank head 102 is shaped as a truncated cone with the plane of the truncation of this cone positioned at the juncture of the head 102 to the remainder of the shank 76. A hex socket 104 can be formed in one of the ends of the shank 76, as for instance head 102, allowing for rotation of the shank 76 to position the shank 76 with respect to the barrel nut 80.

A split bushing 106 fits around the shank 76 partly around the shank head 102 and partly around the tapered tip 100 of the sleeve 96. Because the bushing 106 includes a slot 108 which extends from one of its ends to the other of its ends, it is capable of being expanded. The outside surface 110 of the bushing 106 is formed as a cylindrical surface. The inside of the bushing tapers downwardly from an approximate midpoint 112 toward both of the ends of the bushing 106. As such, the thickness of the bushing 106 at the midpoint 112 is thicker than the thickness of the bushing 106 near either of its ends.

If the sleeve 96 is slid along the shank 76 toward the shank head 102, the tapered surfaces on either side of the midpoint of the bushing 106 engage either the tapered tip 100 on the sleeve 96 or the concal surface on the shank head 102. Further movement of the sleeve 96 toward the shank head 102 causes the split bushing 106 to expand such that its diameter increases, so as to increase its diameter with respect to the diameter of both the shank head 102 and the outside diameter of the sleeve 96.

In use, the fasteners 58 are inserted into a set of aligned holes, such as the holes 48 and 50 seen in FIG. 3. The diameter of the bushing 106 is chosen to be a close fit with the diameter of the holes into which it will be inserted. Once inserted into the aligned holes, the cam handle 86 is rotated so as to engage the cam surfaces 88 against the washer 94 to cause movement of the shank 76 to the right seen in FIG. 3 with respect to the sleeve 96. This brings the shank head 102 toward the sleeve 96 causing the bushing 106 to expand.

It is preferredly to size the length of the shank 76 and sleeve 96 such that the bushing 106 is centered at the die/platen interface.

Additionally, if one die or both dies of the set of dies where formed of two or more independent parts, each of the die parts could be independently mounted to a platen utilizing one or more holes in each die part aligned with a corresponding hole or holes in the platen. The die parts then would be individually attached to the platen utilizing one of the fasteners 58 in each of the holes.

The bushing 106, upon expansion, engages the inside walls of the holes 40 and 50 as it expands until it fixedly engages those walls so as to lock the die 48 to the wall 22. The fasteners 58 are such that when engaged into aligned holes such as holes 40 and 50, the fasteners 58 lock against the inside surfaces of these holes only at the point of contact of the outside surface 110 of the bushing 106. This would be the single point of contact 114 in the holes 40 and 50 as seen in FIG. 3. This securely fastens the fastener 58 to the parts, i.e., the wall 22 and the die 48 into which it is inserted.

I claim:

1. In a combination of a die set and set of supports for holding the dies of said die set, means for connecting each die of said die set to one of said supports and means for causing relative movement between said supports so as to result in relative movement between said dies of said die set the improvement which comprises:

said supports including a first platen and a second platen, each of said platens including a die receiving recess located therein, one of said dies of said set of dies at least partially locatable within said recess of said first platen and the other of said dies of said set of dies at least partially locatable within said recess in the second of said platens;

each of said platens further including a wall, said wall located between the outer periphery of said respective platen and said recess of said respective platen;

said connecting means including said walls on each of said respective platens having a hole extending through said wall and opening into said recess on each of said respective platens and further including each of said dies of said set of dies having a hole which aligns with the hole in said wall of the respective platen when said die of said set of dies which is at least partially locatable in said recess in said respective platen is located in said respective recess;

said connecting means further including a least two expandable diameter fastener means each having a generally cylindrical shape capable of being manipulated so as to expand to a greater diameter at a point along its length, one of said fastener means extending into said aligned holes in each of said dies and said wall of said respective platens with said fastener means expanded at said point to said greater diameter to tightly fit at said point within said aligned holes to fixedly attach each of said dies to their respective platens.

2. The combination of claim 1 wherein:

each of said platens include a first and a second wall with each of said walls located between the outer periphery of said platen and said recess in said respective platen, each of said walls on each of said respective platens having a hole extending through said respective wall and opening into said recess and further including each of said dies having a first and second hole with said first hole aligning with said hole in said first wall of said respective platen and said second hole aligning with said second hole in said respective platen when said die is located in said recess in said respective platen;

four of said expandable diameter fastener means, each of said fasteners fitting into one of said holes in said first and second walls of said first or said second platen and extending into the aligned hole in said respective die when said respective die is located in said recess in said respective platen.

3. The combination of claim 2 wherein:

each of said first and said second walls on each of said respective platens are located on opposite sides of said recess in said respective platen with said recess positioned between said first and said second walls on each of said respective platens.

4. The combination of claim 2 wherein:

said first and said second walls on said first platen further include flange means extending from said wall over a portion of said recess with said die engaged by said flange means on each of said first and said second wall when said die is located within said recess.

5. The combination of claim 1 wherein:

each of said fastener means is capable of being expanded to a greater diameter at a single point along its length.

6. The combination of claim 5 wherein:

when said fastener means are located in said aligned holes between said walls and said dies said point of expansion of each of said fastener means is located at the interface of said die and said wall.

7. The combination of claim 6 wherein:

each of said fastener means further includes a generally cylindrical bushing means located along the shank of said fastener means in a position so as to be located at said interface of said die and said wall when said fastener means is located in said aligned holes of said wall and said die.

8. The combination of claim 1 wherein:

each of said fastener means includes an elongated cylindrical shank having ends and including a truncated conical shank head at one of said ends with said shank head attaching to said shank at the small end of said conical shank head and flaring outwardly in a continuous taper from the diameter of said shank to a greater diameter;

cam means pivotally attaching to the other of said ends of said shank;

an elongated sleeve means having ends, said sleeve means slidably located on said shank between said cam means and said head with one end of said sleeve means in operative association with said cam means so as to be movable on said shank in response to pivoting of said cam means on said shank, said sleeve means having an essentially constant diameter from one of its ends along its length toward the other of its ends and terminating in a tapered tip at said other of its ends, said tapered tip tapering inwardly from said constant diameter in a smooth taper to a smaller diameter at the extremity of the other of said ends;

an expandable bushing means having open ends and slidably located on said shank between said tapered tip of said sleeve means and said shank head, the inside diameter of said bushing means tapering from an essentially midpoint toward each of its ends from a first thickness at said midpoint to second thinner thickness at each of its ends such that when said sleeve means is slid on said shank under the influence of said cam means towards said head said bushing is engaged between said head and said tapered tip of said sleeve means and is expanded as said tapered tip of said sleeve means moves toward said head.

9. The combination of claim 8 wherein:

when said fastener means are located in said aligned holes between said walls and said dies said point of expansion of each of said fastener means is located at the interface of said die and said wall.

10. The combination of claim 9 wherein:

each of said platens include a first and a second wall with each of said walls located between the outer periphery of said platen and said recess in said respective platen, each of said walls on each of said respective platens having a hole extending through said respective wall and opening into said recess and further including each of said dies having a first and second hole with said first hole aligning with said hole in said first wall of said respective platen and said second hole aligning with said second hole in said respective platen when said die is located in said recess in said respective platen;

four of said expandable diameter fastener means, each of said fasteners fitting into one of said holes in said first and second wall of said first or said second platen and extending into the aligned hole in said respective die when said respective die is located in said recess in said respective platen;

each of said fastener means is capable of being expanded to a greater diameter at a single point along its length.

11. The combination of claim 10 wherein:

each of said first and said second walls on each of said respective platens are essentially parallel to one another and further including each of said holes in said first and said second walls on each of said respective platens also being essentially parallel to one another;

said first and said second walls on said first platen further include flange means extending from said wall over a portion of said recess with said die engaged by said flange means on each of said first and said second wall when said die is located within said recess.

12. The combination of claim 6 wherein:

each of said fastener means includes an elongated cylindrical shank having ends and including a truncated conical shank head at one of said ends with said shank head attaching to said shank at the small end of said conical shank head and flaring outwardly in a continuous taper from the diameter of said shank to a greater diameter;

cam means pivotally attaching to the other of said ends of said shank;

an elongated sleeve means having ends, said sleeve means slidably located on said shank between said cam means and said head with one end of said sleeve means in operative association with said cam means so as to be movable on said shank in response to pivoting of said cam means on said shank, said sleeve means having an essentially constant diameter from one of its ends along its length toward the other of its ends and terminating in a tapered tip at said other of its ends, said tapered tip tapering inwardly from said constant diameter in a smooth taper to a smaller diameter at the extremity of the other of said ends;

an expandable bushing means having open ends and slidably located on said shank between said tapered tip of said sleeve means and said shank head, the inside diameter of said bushing means tapering from an essentially midpoint toward each of its ends from a first thickness at said midpoint to second thinner thicknesses at each of its ends such that when said sleeve means is slid on said shank under the influence of said cam means towards said head said bushing is engaged between said head and said tapered tip of said sleeve means and is expanded as said tapered tip of said sleeve means moves toward said head.

13. The combination of claim 12 wherein:

said hole in said wall of said first platen extends in a first plane which is essentially parallel to a plane wherein said hole in said wall of said second platen extends.

14. The combination of claim 6 wherein:

said hole in said wall of said first platen extends in a first plane which is essentially parallel to a plane wherein said hole in said wall of said second platen extends.

* * * * *

UNITED STATES PATENT AND TRADEMARK OFFICE

CERTIFICATE OF CORRECTION

PATENT NO. : 4,552,050

DATED : NOVEMBER 12, 1985

INVENTOR(S) : PETER GREFE

It is certified that error appears in the above-identified patent and that said Letters Patent is hereby corrected as shown below:

Column 4, line 18, "38,38,40" should read --36,38,40--.
Column 4, line 32, "38" should be --46--.
Column 4, line 44, after the word "respective" add the words --platens when the respective dies are located in the respective--.
Column 4, line 61, after the word "influence" add the word --of--.
Column 6, line 6, "concal" should be --conical--.
Column 6, line 14, "48" should be --40--.
Column 6, line 23, "preferredly" should be --preferred--.

Signed and Sealed this

*Twenty-second* Day of *April 1986*

[SEAL]

*Attest:*

DONALD J. QUIGG

*Attesting Officer*

*Commissioner of Patents and Trademarks*